US006315889B1

(12) United States Patent
Thakkar et al.

(10) Patent No.: US 6,315,889 B1
(45) Date of Patent: Nov. 13, 2001

(54) LOW CONVERSION ONCE-THROUGH HYDROCRACKING PROCESS

(75) Inventors: Vasant P. Thakkar, Elk Grove Village; Christopher J. Anderle, Schaumburg; Hemant B. Gala, Arlington Heights, all of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/422,298

(22) Filed: Oct. 21, 1999

(51) Int. Cl.[7] ..... C10G 65/00
(52) U.S. Cl. ..... 208/59; 208/89; 208/209
(58) Field of Search ..... 208/59, 89, 209

(56) References Cited

U.S. PATENT DOCUMENTS 3,779,897 * 12/1973 Wrench et al. ..... 208/59

* cited by examiner

*Primary Examiner*—Helane E. Myers
(74) *Attorney, Agent, or Firm*—John G. Tolomei; John F. Spears, Jr.

(57) ABSTRACT

A feed stream is processed in a hydrotreating reaction zone and then the hydrotreating effluent is separated into two fractions in a first high pressure separator. The vapor fraction is passed into a second high pressure separator. A controlled portion of the liquid fraction from the first high pressure separator and the liquid from the second high pressure separator are passed into a hydrocracking zone. The remaining portion of the liquid from the first high pressure separator is passed into the product recovery zone.

9 Claims, 1 Drawing Sheet

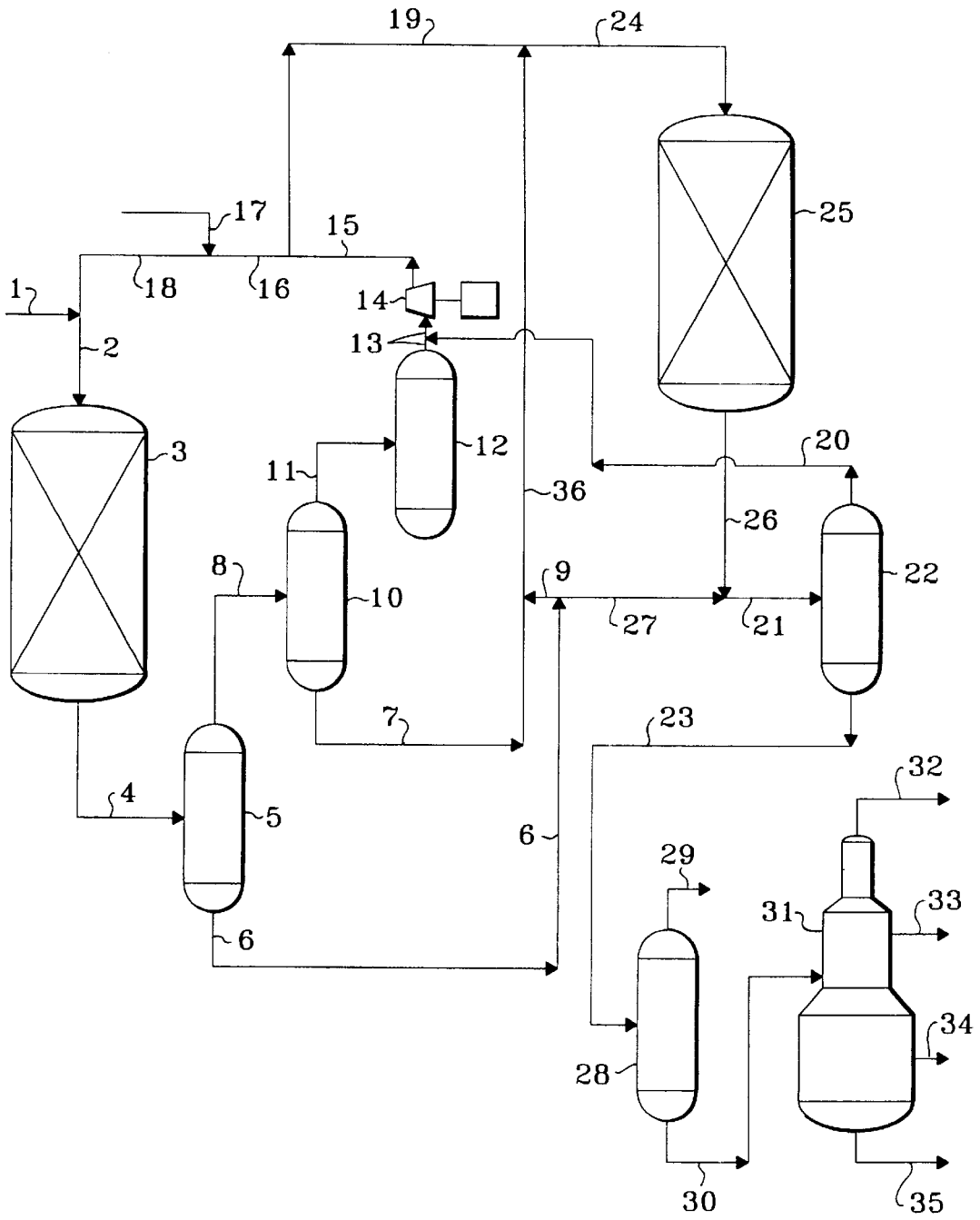
19
24
25
17
15
1
18
16
14
13
2
3
12
11
36
20
26
8
10
9
22
27
21
7
23
4
5
32
6
29
31
33
6
34
28
30
35

LOW CONVERSION ONCE-THROUGH HYDROCRACKING PROCESS

FIELD OF THE INVENTION

The invention relates to a hydrocarbon conversion process referred to in the art as hydrocracking which is used commercially in petroleum refineries to reduce the average molecular weight of heavy or middle fractions of crude oil. The invention more directly relates to an integrated hydrotreating/hydrocracking process which has a specific product separation arrangement. The invention is specifically related to separation of the effluent of a hydrocarbon conversion zone using an augmented high pressure separator upstream of a conventional high pressure separator to allow the division of the hydrotreating reaction zone effluent into recycled and recovered fractions.

BACKGROUND OF THE INVENTION

Large quantities of petroleum derived hydrocarbons are converted into higher value hydrocarbon fractions used as motor fuel by a refining process referred to as hydrocracking. In this process the heavy feed is contacted with a fixed bed of a solid catalyst in the presence of hydrogen at conditions of high temperature and pressure. This results in a substantial portion of the molecules of the feed stream being broken down into molecules of smaller size and greater volatility. The high economic value of petroleum fuels derived from these smaller molecules has led to extensive development of both hydrocracking catalysts and hydrocracking process technology.

The raw petroleum fractions typically charged to a hydrocracking process contain significant amounts of organic sulfur and nitrogen. The sulfur and nitrogen must be removed to meet modern fuel specifications. Removal or reduction of the sulfur and nitrogen is also beneficial to the operation of a hydrocracking reactor. The sulfur and nitrogen is removed by a process referred to as hydrotreating. Due to the similarity of the process conditions employed in hydrotreating and hydrocracking the two processes are often integrated into a single overall process unit having separate sequential reactors dedicated to the two reactions and a common product recovery section.

RELATED ART

Both hydrotreating and hydrocracking are widely practiced commercial processes. The very significant economic utility of the hydrocracking process has resulted in a large effort devoted to the improvement of the process and to the development of better catalysts for use in the process. A general review and classification of different hydrocracking process flow schemes and a description of hydrocracking catalysts is provided at pages 174–183 of the book entitled, *Hydrocracking Science and Technology* authored by Julius Scherzer and A. J. Gruia published in 1996 by Marcel Dekker, Inc. FIGS. 10.2, 10.3 and 10.5 show hydrotreating reactors upstream of the hydrocracking reactor and general process flows. As noted therein it is an established practice to first pass a hydrocracking unit feed stream into a hydrotreating reactor in order to reduce the level of sulfur and nitrogen tied up in the target petroleum molecules. Some form of separation may be employed between the hydrotreating reactor and the hydrocracking reactor to reduce the amount of hydrogen sulfide carried over to the hydrocracking reactor with the hydrocarbon phase.

The high pressures employed in hydrocracking has prompted efforts to conserve the pressure of any portion of the hydrocracking effluent which is to be recycled and to also limit reductions in pressure as a separation mechanism to the product recovery section of the process. The effluent of a high pressure reactor such as a hydrocracking reactor therefore typically flows into a vessel referred to as a high pressure separator (HPS), which operates at a pressure close to the outlet pressure of the reaction zone. High pressure separators are classified as "hot" or "cold" depending on whether the effluent stream is cooled significantly prior to passage into the HPS.

U.S. Pat. No. 3,260,663 issued to T. V. Inwood et al, illustrates the passage of the effluent of an initial hydrotreater 8 into a separator 14 which may be operated at close to the conditions employed in the hydrotreater. The separator contains trays 24, and hydrogen may be charged to the bottom of the separator via line 28. A vapor-phase comprising 650° F.-minus hydrocarbons and hydrogen and a liquid phase stream are removed from the separator and passed into separate hydrocracking zones. The effluent of both hydrocracking reactors shown in the reference is handled in a more conventional manner with the effluent first flowing into a HPS and then the liquid from the HPS flowing into a low pressure separator 66.

The art also includes more complicated separation schemes employing multiple separators. For instance, U.S. Pat. No. 3,471,397 issued to J. T. Fortman et al illustrates the use of a HPS, a hot flash separator and a cold separator. U.S. Pat. No. 3,733,260 issued to J. A. Davies et al shows the use of a hot separator, a hot flash separator, a old separator and a cold flash separator. This reference also illustrates the practice of treating the recycle hydrogen gas stream to remove hydrogen sulfide.

SUMMARY OF THE INVENTION

The invention is a combined sequential hydrotreating and hydrocracking process. The flow scheme of the invention employs two high pressure separators in series to separate the effluent of a hydrotreating reactor in order to provide controlled division of heavy hydrocarbons between a high conversion hydrocracking zone and the product recovery zone of the process. A variable portion of the hydrotreater effluent is thereby bypassed around the hydrocracking zone allowing controlled overall conversion and production of an upgraded "unconverted" bottoms product stream.

A broad embodiment of the invention my be characterized as an integrated hydrocarbon conversion process which employs both a hydrocracking reactor and a hydrotreating reactor, which process comprises passing a feed stream comprising hydrocarbons having boiling points above 700° F. and hydrogen into a hydrotreating reaction zone operated at hydrotreating conditions and producing a hydrotreating reaction zone effluent stream comprising hydrogen, hydrogen sulfide, and unconverted feed components having boiling points above about 700° F.; separating the hydrotreating reaction zone effluent stream in a first high pressure separation zone into a vapor-phase light fraction comprising hydrocarbons having boiling points below about 700° F., and a liquid-phase heavy fraction comprising hydrocarbons having boiling points above about 700° F.; separating the light fraction in a second high pressure separation zone into a recycle gas stream and a liquid process stream; passing a first portion of the heavy fraction, the liquid process stream and hydrogen into a hydrocracking reaction zone operated at hydrocracking conditions, and producing a hydrocracking reaction zone effluent stream; passing the remaining second portion of the heavy fraction and the hydrocracking reaction zone effluent stream into a product recovery zone, and recovering at least one distillate hydrocarbon product stream.

BRIEF DESCRIPTION OF THE DRAWINGS

The drawing is a simplified process flow diagram showing a feed stream entering a hydrotreating reactor 3, with the effluent of this reactor flowing into the first of two sequential high pressure separators 5 and 10 employed in the process.

DETAILED DESCRIPTION AND PREFERRED EMBODIMENTS

Much of the crude petroleum which is produced cannot be used directly as a modern fuel or petrochemical feed stock. It must be refined to remove sulfur and nitrogen which would increase air pollution if present in a fuel. It must also be refined to reduce the average molecular weight of the heavier components of the crude such that the volatility or flow characteristics of fuels are met. Finally, refining is necessary to meet quality standards for specific hydrocarbon products.

The required refining can be done in several ways. One of the more established methods employs sequential catalytic hydrotreating and catalytic hydrocracking reaction zones. This process combination is used in a number of petroleum refineries. The subject invention relates to a novel separation and process flow arrangement between the hydrotreating and hydrocracking reaction zones of such a process. In the subject process only a controlled portion of the hydrotreating zone effluent flows into a high severity hydrocracking reactor. This produces an unexpected improvement in the quality of distillate products, such as a jet fuel recovered from a hydrocracking zone despite an overall low to moderate conversion.

Typical feedstocks include virtually any heavy mineral (petroleum derived) or synthetic oil fraction having boiling points above about 400° F. (204° C.). Thus, such feedstocks as straight run gas oils, vacuum gas oils, demetallized oils, coker distillates, cat cracker distillates, and the like are contemplated. The preferred feedstock should not contain an appreciable amount of asphaltenes. The hydrocracking feedstock may contain nitrogen, usually present as organitrogen compounds in amounts between 1 ppm and 1.0 wt. %. The feed will normally also contain sulfur containing compounds sufficient to provide a sulfur content greater than 0.15 wt. %. It may also contain mono- and/or polynuclear aromatic compounds in amounts ranging between about 30 to 40 volume percent or higher. The compounds in the feed to the hydrotreating zone may have boiling points within the broad range extending from about 400° F. (204° C.) to about 1100° F. (593° C.) and preferably within the range of from about 600° F. (316° C.) to about 1020° F. (549° C.). The feed will often be a blend of materials derived from two or more different sources such as a crude oil atmospheric or vacuum column and a conversion unit. The feeds to the subject process are expected to contain a sizeable amount, e.g. 20–40 vol % of diesel boiling range hydrocarbons requiring little conversion.

In a representative example of a conventional high conversion hydrocracking process, a heavy gas oil is charged to the process and admixed with a hydrocarbon recycle stream. The resultant admixture of these two liquid phase streams is heated in an indirect heat exchange means and then combined with a hydrogen-rich gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

This produces a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions which occur within the hydrocracking reaction zone. The reaction zone effluent will also contain the desired product hydrocarbons boiling in the gasoline, diesel fuel, kerosene and/or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone for heat recovery and then passed into a vapor-liquid separation zone normally including at least one high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream", and/or as the hydrocarbon recycle stream. The recycle stream may be passed into the hydrotreating reactor. It may, however, be passed directly into a hydrocracking reactor. The net drag stream is removed from the process. This allows the use of less severe conditions in the reaction zone(s). The size of the drag stream in a conventional high conversion hydrocracking unit can be in the broad range of 1–10 volume percent of the process feed stream, but is preferably in the range of 1–5 volume percent. In the subject partial conversion process the equivalent to the drag stream is the stream of recovered unconverted oil and is much larger. It can range from at least about 20 to above 40 volume percent of the feed stream.

Over the years, great advances have been made in both hydrotreating and hydrocracking catalysts and process technology. Nevertheless the selectivity of commercial hydrocracking processes for converting feeds to hydrocarbons having boiling points in selected boiling point ranges is far from perfect. Compromises between operating variables are still required in order to optimize the process, and improvement in selectivity remains an industry-wide goal. It is an objective of the subject process to provide a selective hydrocracking process for processing relatively light feeds which require only limited cracking for conversion to the desired products. It is a specific objective of the invention to provide a selective hydrocracking process for use with feed streams that contain a significant amount of hydrocarbons which already boil in the desired product boiling point range.

In the subject process the feed stream is first subjected to a hydrotreating step. This has traditionally been practiced as a means of removing sulfur and nitrogen from the feedstock in order to prepare it for the downstream hydrocracking reactors. One reason for this is that a lower sulfur or nitrogen content tends to increase the observed activity of the hydrocracking catalyst. The hydrotreating zone is a treating zone rather than conversion or cracking zone. The effluent from the hydrotreating zone will preferably comprise an admixture of hydrocarbons having essentially the same boiling point range as the feed which enters the hydrotreating zone. Preferably, only a small amount, less than 10%, conversion occurs in the hydrotreating zone. Most preferably less than 5% conversion occurs in the hydrotreating zone. The conversion which does occur will produce some lower boiling hydrocarbons but the majority of the feed preferably passes through the hydrotreating zone with only a minor boiling point change. Therefore it is the effluent of the second zone which is fractionated to yield the final product distillate streams. Conversion is normally undesired in a hydrotreating process as it reduces the yield and quality of the intended middle distillate products. The term "conversion" as used herein refers to the chemical change necessary to convert feed stream molecules into product hydrocarbons which become part of a distillate product recovered from the effluent of the respective reaction zone as compared to a bottoms or drag stream. It does not relate to hydrotreating type reactions which do not significantly change boiling points.

A characteristic of the subject process is the use of two high pressure separators (HPS). These separators are employed in a modified series flow arrangement unique to the process. In the subject process the vapor phase material separated out in the first HPS is fed into the second HPS. The liquid phase from the first HPS is passed downstream, with at least 25 volume percent of the liquid fraction passed directly into the hydrocracking reaction zone and a separate portion diverted around this zone.

The HPS vessels may contain some limited aids for separation, such as a tray or structured packing, to promote better separation than provided by a simple one-stage flash separation. However, the high pressure in these vessels requires thick vessel walls and conduits which greatly increases the cost of the equipment to a degree that a device such as a column is prohibitively expensive. There is no external reflux or reboiling of the HPS. Thus the separation in the high pressure separators will be inexact and there will be overlap of boiling point ranges of the fractions removed from a HPS.

In the normal parlance of the hydrocracking art a high pressure separator is a separator which is operated at close to the pressure of the upstream reactor. Some pressure reduction such as that inherent in fluid transfer through process lines and control valves will occur, but a HPS will normally be operated at a pressure within 150 psi of the upstream reactor. In the subject process with two HPS vessels in series the second HPS is also preferably operated at a pressure within 150 psi of the hydrotreating reactor. This preference in not reducing the pressure in the HPS is in order to avoid the very significant costs of recompressing the hydrogen rich gas which is recycled to the reaction zones.

It is necessary to cool the vapor phase stream removed from the first HPS in order to effect further separation in the second HPS. The second HPS will therefore be operated at a temperature which is at least 50 and preferably between 100 to 500° F. lower than the temperature in the first HPS. This separation of additional hydrocarbons from the vapor removed from the first HPS is also beneficial as it reduces the amount of hydrocarbons in the gas stream sent to the recycle gas loop.

The drawing is a simplified process flow diagram which does not show customary equipment required for performance of the process such as valves, pumps, and control systems. Referring now to the drawing, the feed stream enters the process via line 1 and is admixed with a hydrogen-rich gas stream passing through line 18. As used herein the term "rich" is intended to indicate the molar concentration of the indicated chemical or class of compounds is greater than 50 percent and preferably greater than 70 percent. The admixture of hydrogen and the feed stream may be heated by a means not shown. It is passed into the hydrotreating reaction zone represented by the reactor 3. The reactions which occur in this zone result in the formation of hydrogen sulfide and ammonia, and some light hydrocarbons by undesired side reactions but no substantial cracking of the heavier hydrocarbons which enter the reactor. There is thereby formed a mixed phase hydrotreating reaction zone effluent stream which is passed through line 4 into a first high pressure separator (HPS) 5. This reactor effluent stream comprises gases such as hydrogen, reaction products and vapor and liquid phase feed hydrocarbons.

The operation of the HPS 5 is set to promote the separation of the entering compounds into vapor and liquid fractions, which will have somewhat overlapping composition. A 700° F. minus vapor-phase fraction is removed through line 8 and passed into a second high pressure separator 10. This fraction will contain the great majority of the hydrogen and the light and intermediate hydrocarbons having boiling points less than 700° F. A liquid-phase heavy fraction rich in hydrocarbons boiling above 700° F. is removed through line 6. In the subject process the liquid phase heavy fraction of line 6 is split into at least two separate portions which are handled differently.

A first portion equal to about 25 to about 80 vol. percent of the heavy fraction of line 6 is separately passed into hydrocracking reaction zone represented by the hydrocracking reactor 25 via lines 9 and 36. The remaining second portion of the heavy fraction of line 6 is diverted through line 27 for passage into the third high pressure separator 22 via line 21. It is preferred that this second portion is also equal to at least 25 volume percent of the heavy fraction of line 6. This division of the heavy fraction is preferably controlled by flow control valves not shown to allow variation in the amount of the fraction which is passed into the HPS 22 and into the reactor 25. Thus the amount of material fed to the hydrocracking zone can be adjusted to compensate for changes in the feed stream composition or in the desired product slate or product quality. In any event the portion of the liquid fraction passed into the HPS 22 bypasses the hydrocracking reactor and thus is only subjected to hydrotreating.

The normally gaseous material and the vapor phase hydrocarbons of line 8 are cooled by a means not shown and then fed into the second high pressure separator 10. The entering materials are separated therein into a second set of vapor and liquid phase fractions, with a process stream containing the entire liquid-phase fraction being passed into the hydrocracking zone 25 via lines 7, 36 and 24. The remaining vapor phase fraction formed in this separation is removed from the second high pressure separator via line 11 and preferably cooled to an intermediate temperature by a means not shown. It is then passed into an optional amine scrubbing zone 12 wherein it is contacted with a liquid that adsorbs hydrogen sulfide. The cooling may cause condensation which would be handled via a separator not shown. The gas is removed from the scrubbing zone in line 13 and pressurized in the recycle gas compressor 14. The thus purified and hydrogen-rich recycle gas stream is then divided into the portions passed into the hydrotreating reactor 3 via line 16 and the hydrocracking reactor 25 via line 19. Make-up hydrogen from line 17 is admixed with the recycle hydrogen of line 16 and fed to the hydrotreating reactor through line 18.

The hydrocracking reaction zone which may actually comprise two or more reactors in a series or in parallel flow arrangement. The contacting of the hydrocarbons with the hydrocracking catalyst at the imposed conditions results in significant cracking of the entering feed hydrocarbon molecules into smaller product molecules which eventually flow to the column 31. The mixed-phase effluent of the hydrocracking zone is passed via lines 26 and 21 into the third high pressure separator 22. This separator concentrates hydrogen from the effluent into a gas stream of line 20, leaving the liquid-phase process stream of line 23, which is sent to the product recovery zone.

The process streams directed to product recovery will first enter one or more separation drums such as the low pressure flash drum 28. Gaseous compounds including light hydrocarbons are removed as a vapor stream carried by line 29 to a gas treating zone not shown. The remaining liquid is passed into a fractionation zone represented by the single column 31, but often comprising both a stripping column such as a debutanizer and a product separation column. The liquid of line 30 is separated into distillate products such as a light naphtha of line 32, a kerosene of line 33 and a diesel boiling range product stream of line 34. The heaviest components are removed as the unconverted oil stream carried by line 35. While characterized as unconverted oil, this is a product stream of the process as all of the hydrocarbons in this stream have been upgraded by passage through the hydrotreating reactor and at least some have passed through the hydrocracking reactor. The unconverted oil should therefore be a good quality feed for an FCC unit or ethylene cracking unit. The upgraded unconverted oil may also be suitable for use as a lube oil base stock. As previously mentioned, the flow rate of the unconverted oil stream will be significant. This is a distinguishing feature of the process. Preferably this stream has a flow rate greater than 25 vol % of the feed stream.

Hydrocarbons removed from the bottom of the product recovery column as a drag stream may be a high value product but are not considered to be either distillates or conversion products for purposes of this definition of conversion. The desired "distillate" products of a hydrocracking process are normally recovered as sidecuts of a product fractionation column and include the naphtha, kerosene and diesel fractions. The product distribution of the subject process is set by the feed composition and the selectivity of the catalyst(s) at the conversion rate obtained in the reaction zones at the chosen operating conditions. It is therefore subject to considerable variation. The subject process is especially useful in the production of middle distillate fractions boiling in the range of about 260–700° F. (127–371° C.) as determined by the appropriate ASTM test procedure.

The subject process employs two different types of catalyst, hydrotreating catalyst and hydrocracking catalyst. These two types of catalysts normally share many similarities. For instance, they may have relatively similar particle shape and size. Both normally comprise an inorganic support material and at least one hydrogenation metal. The two types of catalysts will, however, also differ significantly since each has been tailored to perform a different function. One of the most obvious differences is that the hydrocracking catalyst will also comprise one or more acidic cracking components, such as silica-alumina and/or Y-zeolite. The two types of catalysts are also expected to differ in other ways such as in terms of the metals employed as the hydrogenation component, the particle's pore volume distributions and density, etc. Suitable catalysts for use in the reaction zones of this process are available commercially from several vendors.

Hydrotreating catalysts typically do not contain zeolitic materials or molecular sieve materials and often comprise only one or more metals on an amorphous alumina. Much of the art and technology involved with the production of hydrotreating catalyst is centered upon the identity and amount of the metals in the catalyst, the methods chosen for the impregnation of the metals into the catalyst, the relative metal concentration profiles, the pore structure and distribution of the alumina and the overall geometry of the catalyst particle.

Both the hydrocracking and hydrotreating catalyst will typically comprise a base metal hydrogenation component chosen from nickel, cobalt, molybdenum and tungsten and, in the hydrotreating catalyst possibly promoters such as phosphorous, supported on an inorganic oxide catalyst. The hydrogenation metals are usually a Group VIB and/or a Group VIII metal component, with each base metal being present at a concentration based upon the finished catalyst equal to about to 2 to about 18 wt. % measured as the common metal oxide. A more expensive platinum group metal is preferably present at a lower concentration of about 0.1 to 1.5 wt. %. A preferred form of the catalysts is an extrudate having a symmetrical cross-sectional shape, which is preferably a cylindrical or polylobal shape. The cross-sectional diameter of the particles is usually from about 1/40 to about 1/8 inch and preferably about 1/32 to about 1/12 inch. A quadralobal cross-sectional shape resembling that of a four leaf clover is shown in U.S. Pat. No. 4,028,227. Other shapes which may be employed in the catalyst are described in this patent and in U.S. Pat. No. 4,510,261. These patents are incorporated for their teaching as to the production of catalysts and potential shapes for both catalysts used in the process.

A preferred high activity hydrotreating catalyst comprises a hydrogenation component comprising nickel and molybdenum on an extruded porous support of phosphorous containing alumina. Details on the production of hydrotreating catalysts containing these four components are provided in U.S. Pat. Nos. 4,738,944; 4,818,743 and 5,389,595 which are incorporated herein for this teaching.

Both the hydrotreating and hydrocracking catalysts preferably comprise a support material which is highly porous, uniform in composition and relatively refractory to the conditions utilized in the hydrocarbon conversion process. The catalysts may comprise a variety of support materials which have traditionally been utilized in hydrocarbon conversion catalysts such as refractory inorganic oxides including alumina, zirconium dioxide, silica-alumina, silica-magnesia, alumina-boria, silica-zirconia, silica or silica gel, clays, etc. The preferred support material for the hydrotreating catalyst is alumina.

The composition and physical characteristics of the catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The reaction zones therefore do not need to be fixed bed systems as depicted on the Drawing.

A spherical catalyst for use in either the hydrotreating section or the hydrocracking section of the process may be formed by use of an oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. Other references describing oil dropping techniques for catalyst manufacture include U.S. Pat. Nos. 4,273,735; and 4,542,113. The production of spherical catalyst particles by different methods is described in U.S. Pat. Nos. 4,599,321; 4,628,040 and 4,640,807.

It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. Preferably, the Y zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. It is contemplated that other zeolites, such as Beta, Omega, L or ZSM-5, could be employed as the zeolitic component of the hydrocracking catalyst in place of or in addition to the preferred Y zeolite.

The term "middle distillate" is intended to include the diesel, jet fuel and kerosene boiling range fractions. The terms "kerosene" and "jet fuel boiling point range" are intended to refer to about 260–550° F. (127–288° C.) and diesel boiling range is intended to refer to hydrocarbon boiling points of 260–700° F. (127–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699 for further details on kerosene and diesel fuel properties and to D-1655 for aviation turbine feed. These definitions provide for the inherent variation in feeds and desired products which exists between different refineries. Typically, this definition will require the production of distillate hydrocarbons having boiling points below about 700° F. (371° C.).

While the hydrotreating zone is maintained at what is referred to as hydrotreating conditions and the hydrocracking zone is kept at hydrocracking conditions, these conditions are somewhat similar. The pressure maintained in both the hydrotreating and hydrocracking reaction zones should be within the broad range of about 400 to 2500 psia (2758–17,238 kpa). It is preferred to employ pressure above 1500 psia (10,343 kPa) in the hydrocracking zone. The reaction zones are preferably operated in mixed-phase conditions with a hydrogen to hydrocarbon ratio of about 5,000 to 18,000 standard cubic feet of hydrogen per barrel of feedstock (843 to 3033 standard meter$^3$ per meter$^3$). The hydrotreating zones may be operated at an inlet temperature of about 450 to 670° F. (232–354° C.). The hydrocracking zones may be operated with an inlet temperature of 640–800° F. (338–426° C.). In the subject process the reaction zones are operated at conditions which include liquid hourly space velocities of from about 0.2 to 10 hr$^{-1}$, and preferably about 1.0 to about 2.5 hr$^{-1}$.

We claim as our invention:

1. An integrated hydrocarbon conversion process which comprises:

a.) passing a feed stream comprising feed hydrocarbons and hydrogen into a hydrotreating reaction zone operated at hydrotreating conditions and producing a hydrotreating reaction zone effluent stream comprising hydrogen, hydrogen sulfide, and unconverted feed hydrocarbons;

b.) separating the hydrotreating reaction zone effluent stream in a first high pressure separation zone into a vapor phase light fraction and a liquid phase heavy fraction;

c.) separating the light fraction in a second high pressure separation zone into a recycle gas stream and a liquid process stream;

d.) passing a first portion of the heavy fraction, the liquid process stream and hydrogen into a hydrocracking reaction zone operated at hydrocracking conditions, and producing a hydrocracking reaction zone effluent stream;

e.) passing the remaining second portion of the heavy fraction and the hydrocracking reaction zone effluent stream into a product recovery zone, and recovering at least one distillate hydrocarbon product stream.

2. The process of claim 1 wherein at least 25 volume percent of the heavy fraction withdrawn from the first high pressure separation zone is passed into the hydrocracking reaction zone.

3. The process of claim 2 wherein at least 25 volume percent of the heavy fraction withdrawn from the first high pressure separation zone is passed into the product recovery zone.

4. An integrated hydrocarbon conversion process employing both a hydrocracking reactor and a hydrotreating reactor, which process comprises:

a.) passing a feed stream comprising feed hydrocarbons having boiling points above 700° F. and hydrogen into a hydrotreating reaction zone operated at hydrotreating conditions and producing a hydrotreating reaction zone effluent stream comprising hydrogen, hydrogen sulfide, and unconverted feed hydrocarbons having boiling points above about 700° F.;

b.) separating the hydrotreating reaction zone effluent stream in a first high pressure separation zone into a light fraction comprising feed hydrocarbons having boiling points below about 700° F., and a heavy fraction comprising hydrocarbons having boiling points above about 700° F.;

c.) separating the light fraction in a second high pressure separation zone into a recycle gas stream comprising hydrogen and a liquid process stream;

d.) passing the liquid process stream, a first portion of the heavy fraction and hydrogen into a hydrocracking reaction zone operated at hydrocracking conditions, and producing a hydrocracking reaction zone effluent stream;

e.) passing the remaining second portion of the heavy fraction and the hydrocracking reaction zone effluent stream into a product recovery zone, and recovering at least one distillate hydrocarbon product stream and a bottoms product stream comprising unconverted hydrocarbons.

5. The process of claim 4 wherein at least 25 volume percent of the heavy fraction is passed into the hydrocracking zone.

6. The process of claim 5 wherein at least about 25 volume percent of the heavy fraction is passed into the product recovery zone as said second fraction.

7. The process of claim 4 wherein the second portion of the heavy fraction and the hydrocracking reaction zone effluent stream are passed into a third high pressure separation zone.

8. The process of claim 7 wherein the bottoms product stream has a flow rate greater than 25 vol. % of the feed stream.

9. The process of claim 4 wherein the bottoms product stream has a flow rate equal to about 20 to about 40 vol. % of the feed stream.

* * * * *